US007134529B2

(12) United States Patent
Maury

(10) Patent No.: US 7,134,529 B2
(45) Date of Patent: Nov. 14, 2006

(54) SAFETY DEVICE FOR AN ELEVATOR

(75) Inventor: Julien Maury, Mulhouse (FR)

(73) Assignee: Inventio AG, Hergiswil (CH)

( * ) Notice: Subject to any disclaimer, the term of this patent is extended or adjusted under 35 U.S.C. 154(b) by 341 days.

(21) Appl. No.: 10/770,831

(22) Filed: Feb. 3, 2004

(65) Prior Publication Data

US 2004/0178023 A1 Sep. 16, 2004

(30) Foreign Application Priority Data

Feb. 4, 2003 (EP) ..... 03405057

(51) Int. Cl.
*B66B 5/16* (2006.01)

(52) U.S. Cl. ..... 187/359; 187/351; 187/360; 187/367; 187/373

(58) Field of Classification Search ..... 187/351, 187/359, 360, 367, 373, 343
See application file for complete search history.

(56) References Cited

U.S. PATENT DOCUMENTS 5,495,919 A * 3/1996 Ericson et al. ..... 187/373
5,950,768 A * 9/1999 Gensike et al. ..... 187/376
6,092,630 A * 7/2000 Wendel et al. ..... 187/373
6,564,907 B1 * 5/2003 Sasaki ..... 187/373

FOREIGN PATENT DOCUMENTS

JP 02 144389 8/1990
JP 2000 219450 1/2001

* cited by examiner

*Primary Examiner*—Kathy Matecki
*Assistant Examiner*—Terrell Mathews
(74) *Attorney, Agent, or Firm*—Butzel Long

(57) ABSTRACT

A safety device includes a trigger mechanism for triggering a braking wedges attached to first and second double levers to stop an elevator car. A retaining spring detents with a pin on the first double lever and a tension spring engages either the first double lever or the second double lever. The retaining spring maintains the double levers unactuated during normal operation of the elevator and the spring element actuates the double levers after an actuation of the trigger mechanism by a speed limiter.

14 Claims, 3 Drawing Sheets

SAFETY DEVICE FOR AN ELEVATOR

BACKGROUND OF THE INVENTION

The present invention relates to a safety device for an elevator with an elevator car, which car is movable in an elevator shaft, and a counterweight, which counterweight is movable in the elevator shaft, wherein a speed limiter monitoring the speed of the elevator car or of the counterweight is provided and in the case of excess speed actuates a trigger mechanism stopping the elevator car or the counterweight.

A device for triggering a safety brake, which brake is arranged at an elevator car, with braking wedges is shown in the Japanese patent specification JP 2000219450. A limiter cable of a speed limiter monitoring the speed of the elevator car is connected with a first lever arranged at a first axle. The limiter cable is blocked in the case of excess speed of the elevator car, wherein the first lever sets the first axle into rotational movement due to the movement of the elevator car relative to the limiter cable. A second lever, which is connected with the safety brake and by means of which the rotational movement of the first axle causes the braking wedges of the safety brake to engage, is arranged at the first axle. A third lever, which transmits the rotational movement of the first axle to a second axle arranged at the other side of the elevator car, is arranged at the first axle. The braking wedges of the safety brake of the other side of the elevator car are caused to engage by means of the rotational movement of the second axle. A tension spring connected at one end of the first lever and at the other end with a car frame prevents an undesired engagement of the braking wedges triggered by cable oscillations of the limiter cable.

A disadvantage of this known device resides in the fact that the tension spring fixes the trigger mechanism in the starting setting until the limiter cable overcomes the spring force. A second braking check following the first braking check without delay is not feasible with this trigger mechanism.

SUMMARY OF THE INVENTION

The present invention concerns a device for engagement of the safety brake of an elevator car or a counterweight in every case.

The advantages achieved by the device according to the present invention are that the safety of the elevator passengers can be substantially improved. It is ensured after a braking check triggered by the limiter cable that the safety brake is not engaged again by a signal triggered by the counterweight. After a first braking check of the elevator car the counterweight leaps upwardly due to inertia and on falling back pulls the elevator car out of the braking check. The trigger mechanism according to the present invention has the effect that thereafter the braking wedges are engaged again without delay. It is further of advantage that the existing trigger mechanism is still usable and only has to be supplemented with additional elements. Thus, a new certification of the elevator is not necessary.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
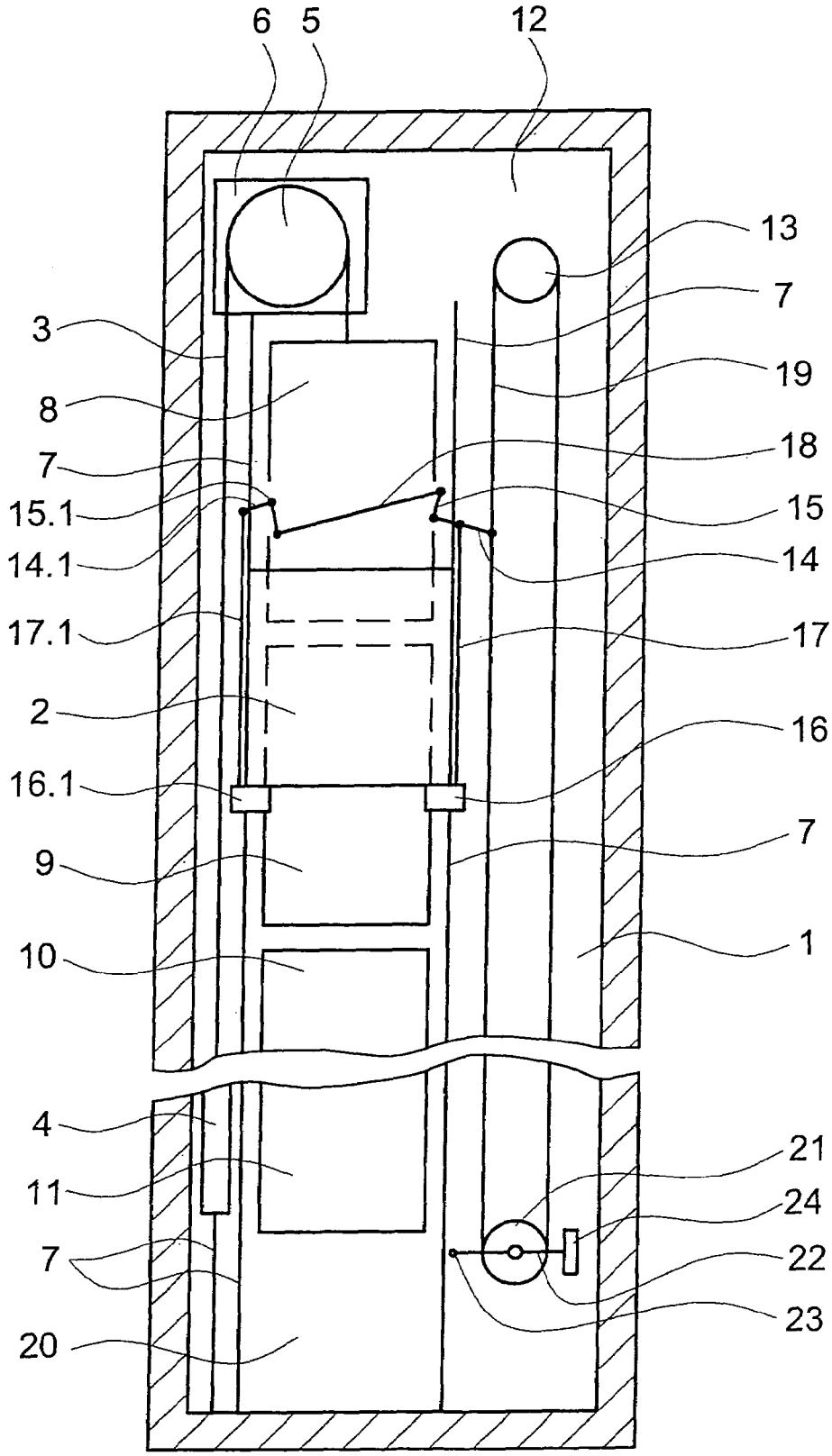
FIG. 1 is a schematic elevation view of an elevator with a trigger mechanism according to the present invention for fixing an elevator car or a counterweight in the case of emergency.

FIG. 1 shows an elevator installation with an elevator car 2, which is movable in an elevator shaft 1 and which is connected with a counterweight 4 movable in the shaft by way of a cable 3. The cable 3 is driven in the operational case by means of a drive pulley 5 of a drive unit 6. The elevator car 2 and the counterweight 4 are guided by means of guide rails 7 extending over the shaft height. The elevator installation comprises an upper floor with an uppermost floor door 8, a second-uppermost floor with a second-uppermost floor door 9, further floors with further floor doors 10 and a lowermost floor with a lowermost floor door 11. Arranged in a shaft head 12 are the drive unit 6 and a speed limiter 13, which monitors the speed of the elevator car 2 and stops the elevator car 2 in the case of excess speed. Each one of a pair of double levers 14 and 14.1, which are pivoted at fulcrums 15 and 15.1 respectively, is provided at each side of the elevator car 2.

A safety brake 16, 16.1 provided for stopping the elevator car 2 is connected by means of a first linkage 17, 17.1 respectively with one side of the double lever 14, 14.1, wherein the one side of the first double lever 14 is connected with a limiter cable 19 of the speed limiter 13. The other side of the first double lever 14 is connected with the second double lever 14.1 by means of a second linkage 18. If the one side of the first double lever 14 is moved upwardly, then the safety brake 16, 16.1 is engaged, wherein blocking elements (not shown) wedging with the guide rail 7 stop the elevator car 2 in the case of an emergency. In normal operation, the elevator car 2 drives the limiter cable 19 by means of the first double lever 14. In the case of excess speed of the elevator car 2 the speed limiter 13 blocks the limiter cable 19. The first double lever 14 is thereby pivoted upwardly and actuates the second double lever 14.1, wherein the safety brake 16, 16.1 at both sides of the elevator car 2 is engaged.

The endless limiter cable 19 is tensioned by means of a deflecting roller 21 arranged in a shaft pit 20, wherein a roller axle 22 is pivoted at one end at a fulcrum 23 and carries a tensioning weight 24 at the other end.

Figure 2:
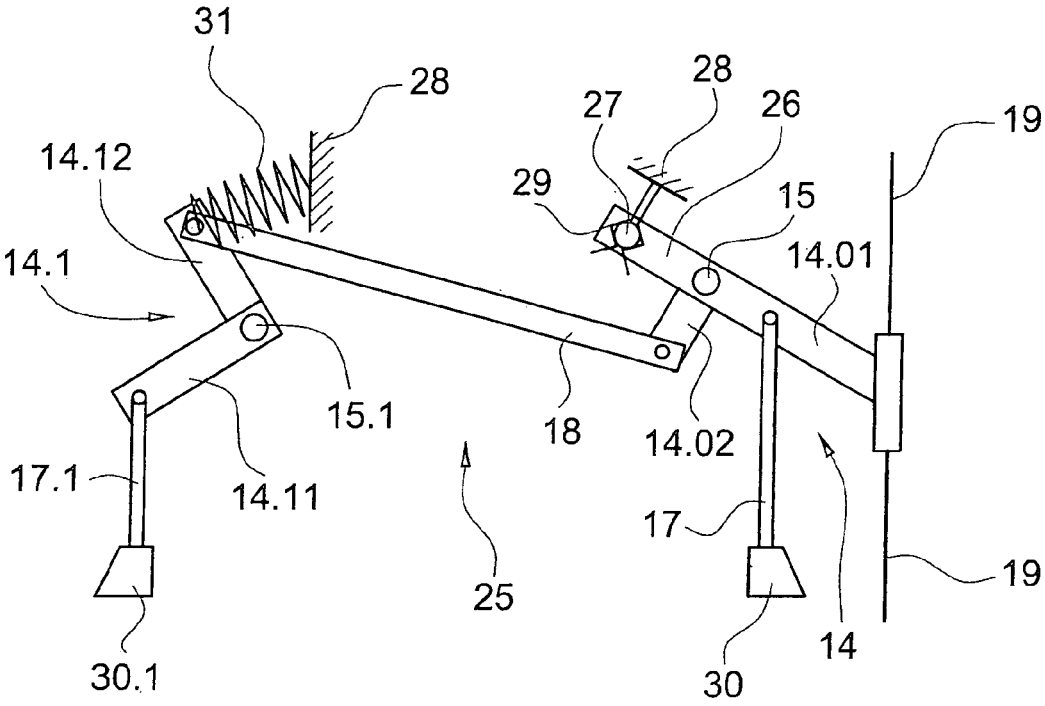
FIG. 2 is an enlarged view of the trigger mechanism shown in FIG. 1 in normal operation.

FIG. 2 shows a trigger mechanism 25 according to the present invention, incorporating the trigger mechanism parts shown in FIG. 1, in normal operation. The first double lever 14 has an arm 26 at which a pin 27 is arranged. The pin 27 detents with a retaining spring 29, which is arranged at a carrier frame 28 and which ensures that cable oscillations or inertia forces of the limiter cable 19 do not actuate the first double lever 14. Thus, the retaining spring 29 maintains the first double lever 14 in an unactuated position during normal operation of the elevator car 2. The first double lever 14 mounted at the first fulcrum 15 has a first leg 14.01, which is articulated to the limiter cable 19, and a second leg 14.02, to which the second linkage 18 is articulated. The first linkage 17, which actuates the blocking element constructed as a braking wedge 30, is also articulated to the first leg 14.01.

The second double lever 14.1 pivoted at the second fulcrum 15.1 has a first leg 14.11 at which the first linkage 17.1, which actuates the blocking element constructed as a braking wedge 30.1, is articulated. A second leg 14.12 of the second double lever 14.1 is pivotably connected with the second linkage 18. A tensioned tension spring 31 is connected at one end with the second leg 14.12 and at the other end with the carrier frame 28 of the elevator car 2. The force emanating from the tension spring 31 cannot actuate the first double lever 14, which is fixed by means of the retaining spring 29, in normal operation.

Figure 3:
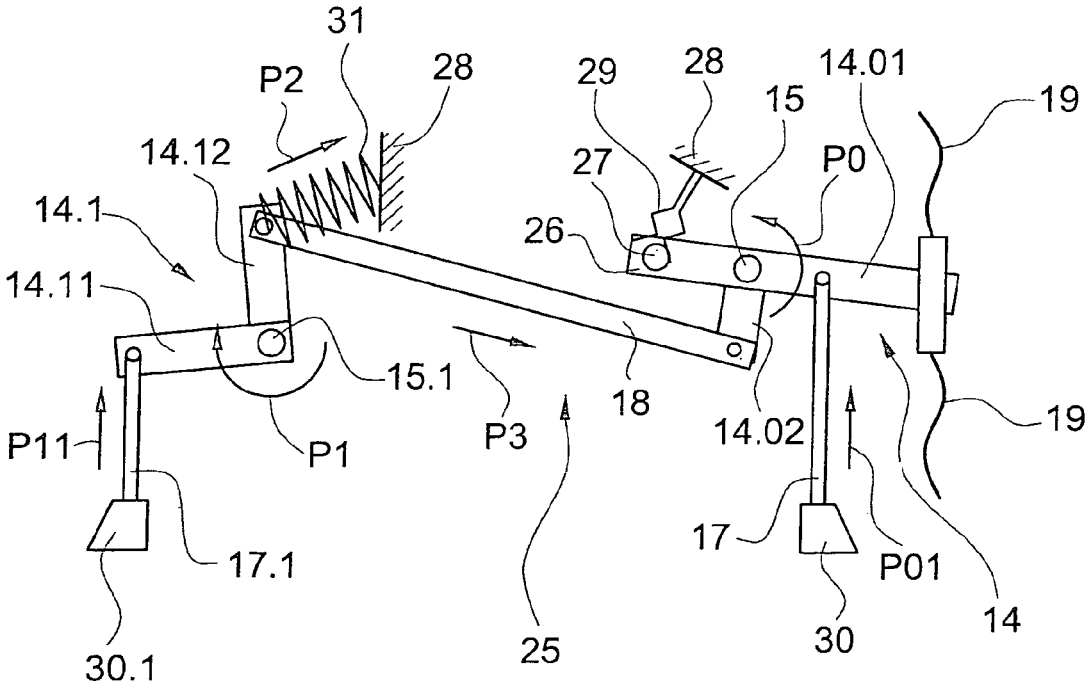
FIG. 3 shows the trigger mechanism of FIG. 2 in the case of a braking check.

FIG. 3 shows the trigger mechanism 25 during a braking check, wherein the blocking elements 30, 30.1 wedging with the guide rail 7 stop the elevator car 2 in the case of an emergency. When the limiter cable 19 is blocked, the first double lever 14 and the second double lever 14.1 are set into rotational movement symbolized by arrows P0, P1 respectively, wherein the first double lever 14 is released by the retaining spring 29 and the braking wedges 30, 30.1 are moved in the direction symbolized by arrows P01, P11 and wedge with the guide rail 7.

After the first braking check of the elevator car 2, which is triggered by the speed limiter 13, the counterweight 4 leaps upwardly due to the inertia force and upon falling back draws the elevator car 2 out of the first braking check. The force, which is symbolized by an arrow P2, of the tension spring 31 now actuates the second double lever 14.1 in the rotational direction P1 and the second linkage 18 in the direction symbolized by an arrow P3, wherein the first double lever 14 is actuated in the rotational direction P0. The braking wedges are moved in the direction P01, P11 and the elevator car 2 is brought into the second braking check by the rotational movement P0, P1 of the double lever 14, 14.1. The second braking check cannot be triggered by the speed limiter 13, because the elevator car 2 when springing up again sets free the blocked speed limiter 13.

Figure 4:
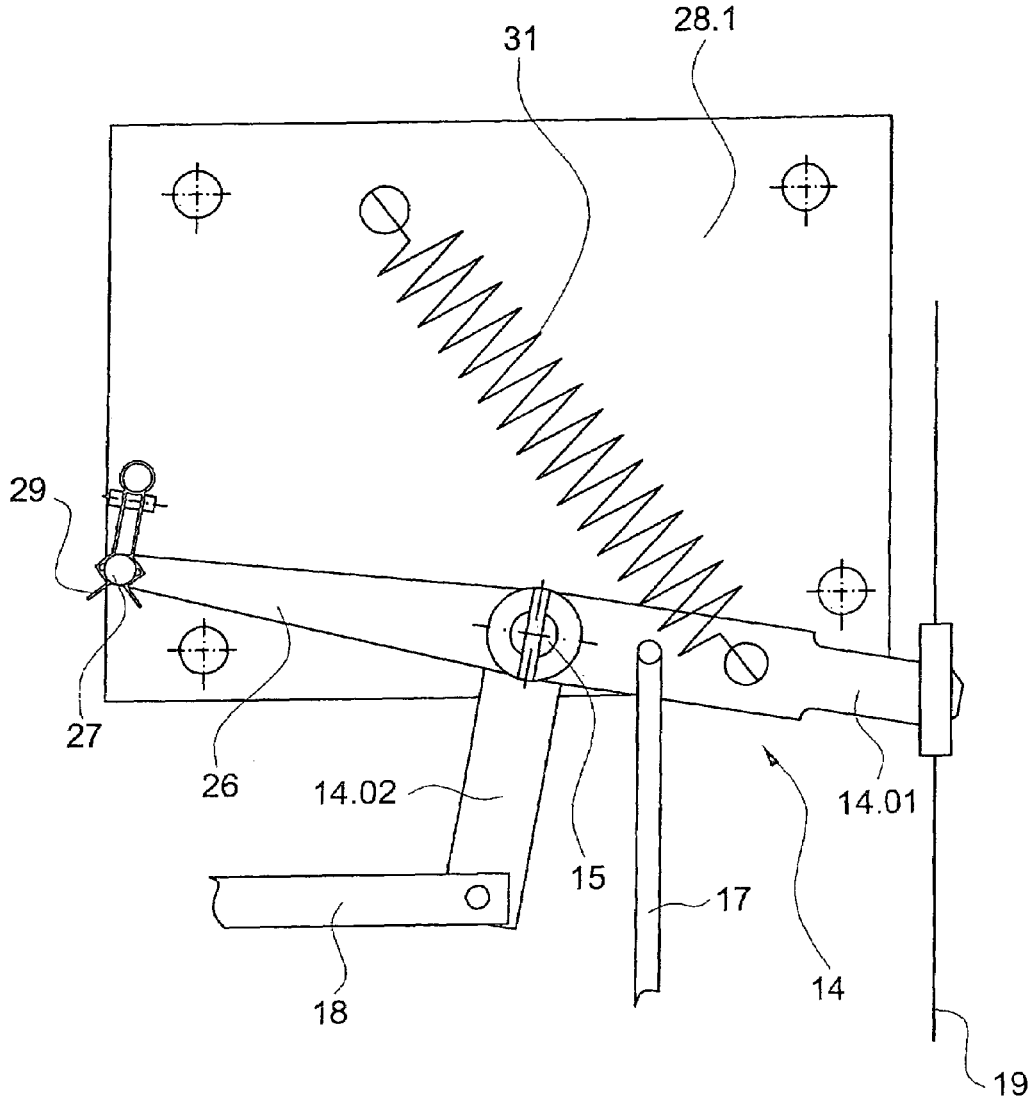
FIG. 4 is a schematic view of an alternate embodiment of the trigger mechanism according to the present invention.

FIG. 4 shows an alternate embodiment of the trigger mechanism. The double lever 14 is arranged at a housing 28.1, which is arranged at the carrier frame 28. By contrast to the embodiment shown in FIGS. 2 and 3, the tension spring 31 engages at the first leg 14.01 of the double lever 14. In this embodiment, the trigger mechanism is of compact construction. In addition, the tension spring 31 together with the retaining spring 29 can be seen.

FIG. 1 shows the elevator installation without an engine room. The safety device according to the present invention for stopping the elevator car can also be used on an elevator installation with an engine room.

The trigger mechanism 25 can also be used on the counterweight 4.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A safety device for an elevator installation having an elevator car that is movable in a elevator shaft and is connected to a counterweight that is movable in the elevator shaft, the elevator installation further having a speed limiter monitoring a speed of the elevator car or of the counterweight and in the case of excess speed actuates a trigger mechanism for stopping the elevator car or the counterweight, the trigger mechanism comprising:

a retaining spring fixed to the elevator car;

a double lever having a pin releasably engaged with said retaining spring; and a tension spring fixed to the elevator car and engaging said double lever whereby said retaining spring maintains said double lever in an unactuated position during normal operation of the elevator car and said tension spring element actuates said double lever after an actuation of the trigger mechanism by the speed limiter causes a first braking check thereby causing a second braking check.

2. The safety device according to claim 1 wherein said double lever includes a first double lever having said pin mounted thereon and a second double lever engaging said tension spring, said first and second double levers being connected by a linkage.

3. The safety device according to claim 2 wherein said first double lever includes an arm upon which said pin is mounted.

4. The safety device according to claim 1 wherein said double lever includes a first double lever having said pin mounted thereon and engaging said tension spring and a second double lever being connected to said first double lever by a linkage.

5. The safety device according to claim 4 wherein and said first double lever includes an arm upon which said pin is mounted.

6. The safety device according to claim 1 wherein said double lever includes a first double lever having a first leg attached to a cable of the speed limiter and a second leg pivotally connected to a linkage, and a second double lever having a leg pivotally connected to said linkage.

7. The safety device according to claim 1 wherein said double lever includes a first double lever having a first leg and a second leg, said first leg being attached to a cable of the speed limiter and to a first braking wedge.

8. The safety device according to claim 7 wherein said double lever includes a second double lever having a first leg and a second leg, said second double lever first leg being attached to a second braking wedge and said second double lever second leg being pivotally connected to a linkage, and said first double lever second leg being pivotally attached to said linkage.

9. The safety device according to claim 8 wherein said first double lever has an arm upon which said pin is mounted.

10. The safety device according to claim 9 wherein said tension spring engages said first double lever first leg.

11. A safety device for an elevator installation having an elevator car that is movable in a elevator shaft and is connected to a counterweight that is movable in the elevator shaft, the elevator installation further having a speed limiter monitoring a speed of the elevator car or of the counterweight and in the case of excess speed actuates a trigger mechanism for stopping the elevator car or the counterweight, the trigger mechanism comprising:

a retaining spring fixed to the elevator car;

a first double lever having a pin releasably engaged with said retaining spring;

a second double lever;

a linkage pivotally attached to said first and second double levers; and a tension spring fixed to the elevator car and engaging one of said first and second double levers whereby said retaining spring maintains said first and second double levers in an unactuated position during normal operation of the elevator car and said tension spring element actuates said first and second double levers after an actuation of the trigger mechanism by the speed limiter causes a first braking check thereby causing a second braking check.

12. The safety device according to claim 11 wherein said second double lever has a leg pivotally attached to said linkage and engaging said tension spring.

13. The safety device according to claim 11 wherein said first double lever has an arm upon which said pin is mounted.

14. The safety device according to claim 11 wherein said first double lever has a first leg engaging said tension spring and a second leg pivotally attached to said linkage.

* * * * *